US011542949B1

(12) United States Patent
Bell

(10) Patent No.: US 11,542,949 B1
(45) Date of Patent: Jan. 3, 2023

(54) HELICOID IN A TUBE

(71) Applicant: Tracy T. Bell, Clarkesville, GA (US)

(72) Inventor: Tracy T. Bell, Clarkesville, GA (US)

( * ) Notice: Subject to any disclaimer, the term of this patent is extended or adjusted under 35 U.S.C. 154(b) by 308 days.

(21) Appl. No.: 16/995,917

(22) Filed: Aug. 18, 2020

(51) Int. Cl.
*F04D 13/04* (2006.01)
*F04D 29/18* (2006.01)
*F04D 29/049* (2006.01)

(52) U.S. Cl.
CPC ..... *F04D 13/04* (2013.01); *F04D 29/049* (2013.01); *F04D 29/181* (2013.01)

(58) Field of Classification Search
CPC ..... F04D 13/04; F04D 29/049; F04B 19/12; F03B 3/10; F03B 3/103; F01D 1/04; F01D 5/02; F01D 5/021; H02K 2207/03
See application file for complete search history.

(56) References Cited

U.S. PATENT DOCUMENTS

| | | | | |
|---|---|---|---|---|
| 2,568,903 A * | 9/1951 | Vassar | B63H 1/28 | 440/48 |
| 4,239,449 A * | 12/1980 | Bauer | F04B 19/12 | 416/177 |
| 5,425,617 A * | 6/1995 | Teran | F01D 5/021 | 415/72 |
| 7,018,170 B2 * | 3/2006 | Rosefsky | F03D 3/005 | 415/176 |
| 2022/0003223 A1 * | 1/2022 | Keatch | F04B 19/12 | |

* cited by examiner

*Primary Examiner* — Sabbir Hasan
*Assistant Examiner* — Jackson N Gillenwaters
(74) *Attorney, Agent, or Firm* — Kyle A. Fletcher, Esq.

(57) ABSTRACT

The helicoid in a tube is an energy conversion device. The helicoid in a tube converts energy in a manner selected from the group consisting of: a) converting the inertia of the mass of the flow of a fluid through the helicoid in a tube into rotational energy; b) converting a rotational energy into a change in the inertia of the mass of the flow of the fluid through the helicoid in a tube; and, c) converting the inertia of the mass of the flow of a fluid through the helicoid in a tube into fluid turbulence, cavitation, and heat in the form of friction. The helicoid in a tube incorporates a turbine stator and a turbine rotor. The turbine rotor installs in the turbine stator.

19 Claims, 4 Drawing Sheets

HELICOID IN A TUBE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of mechanical engineering, more specifically, a blade structure for a radial flow turbine. (F01D5/04)

SUMMARY OF INVENTION

The helicoid in a tube is an energy conversion device. The helicoid in a tube converts energy in a manner selected from the group consisting of: a) converting the inertia of the mass of the flow of a fluid through the helicoid in a tube into rotational energy; b) converting a rotational energy into a change in the inertia of the mass of the flow of the fluid through the helicoid in a tube; and, c) converting the inertia of the mass of the flow of a fluid through the helicoid in a tube into fluid turbulence, cavitation, and heat in the form of friction. The helicoid in a tube comprises a turbine stator and a turbine rotor. The turbine rotor installs in the turbine stator. The turbine rotor rotates within the turbine stator when the helicoid in a tube converts the inertia of the mass of the flow of the fluid through the helicoid in a tube into rotational energy. The turbine rotor rotates within the turbine stator when the helicoid in a tube converts rotational energy into a change in the inertia of the mass of the flow of the fluid through the helicoid in a tube. The position of the turbine rotor within the turbine rotor remains stationary when the helicoid in a tube converts the inertia of the mass of the flow of the fluid through the helicoid in a tube into fluid turbulence, cavitation, and heat in the form of friction.

These together with additional objects, features and advantages of the helicoid in a tube will be readily apparent to those of ordinary skill in the art upon reading the following detailed description of the presently preferred, but nonetheless illustrative, embodiments when taken in conjunction with the accompanying drawings.

In this respect, before explaining the current embodiments of the helicoid in a tube in detail, it is to be understood that the helicoid in a tube is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the helicoid in a tube.

It is therefore important that the claims be regarded as including such equivalent construction insofar as they do not depart from the spirit and scope of the helicoid in a tube. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
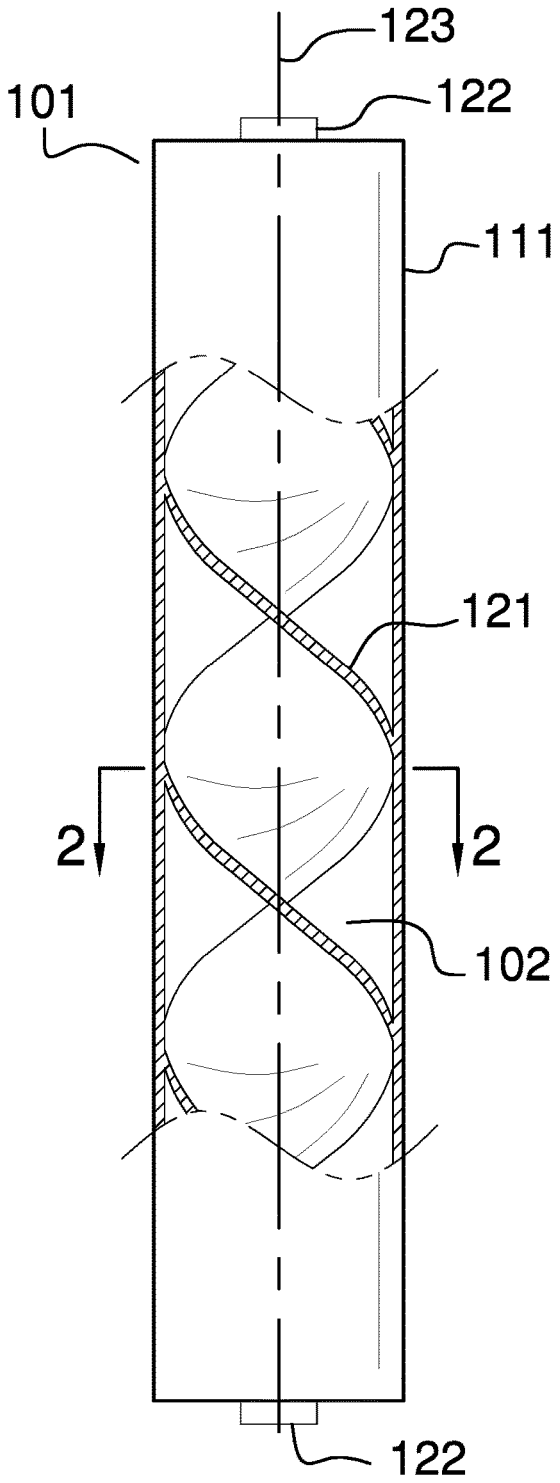
FIG. 1 is a front view of an embodiment of the disclosure.
Figure 2:
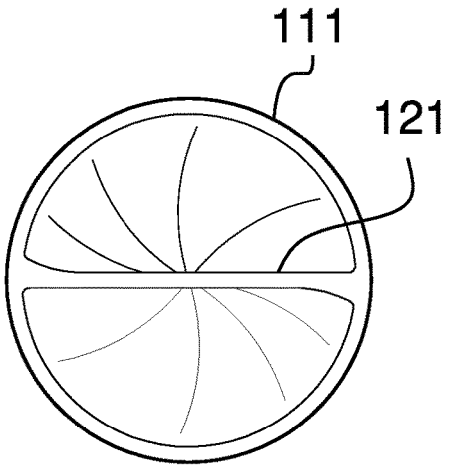
FIG. 2 is a cross-sectional view of an embodiment of the disclosure across 2-2 as shown in FIG. 1.
Figure 3:
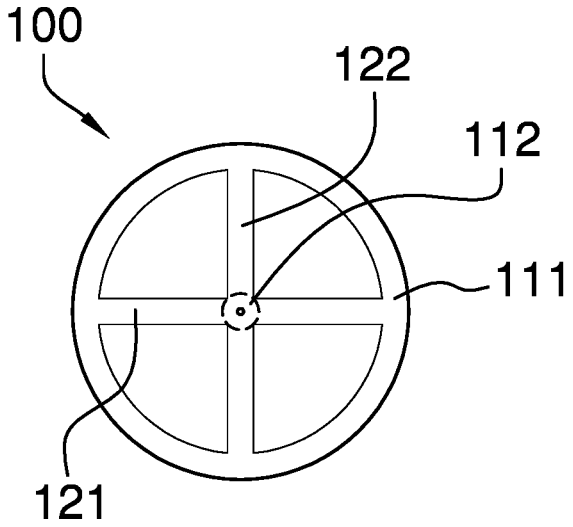
FIG. 3 is a top view of an alternate embodiment of the disclosure.
Figure 4:
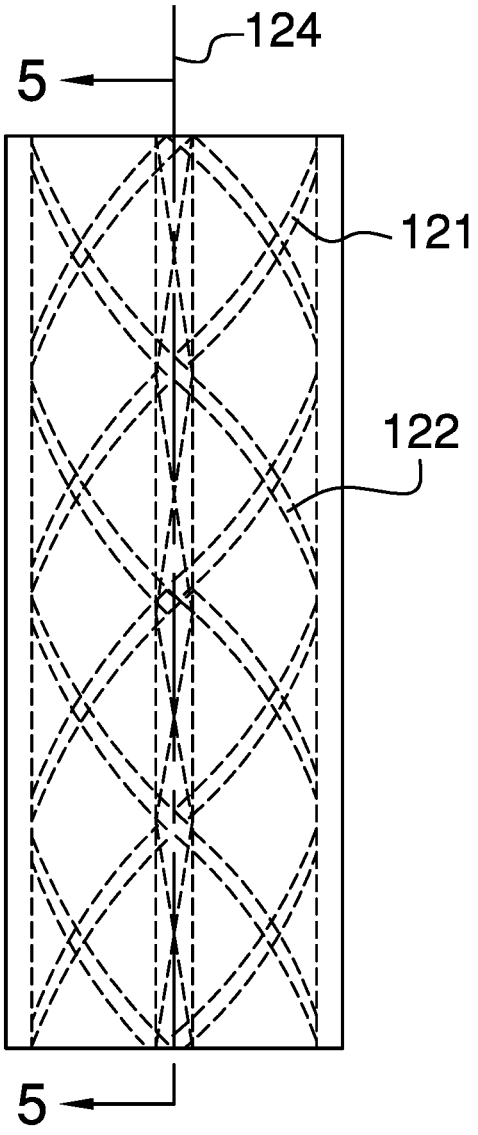
FIG. 4 is a front view of an alternate embodiment of the disclosure.
Figure 5:
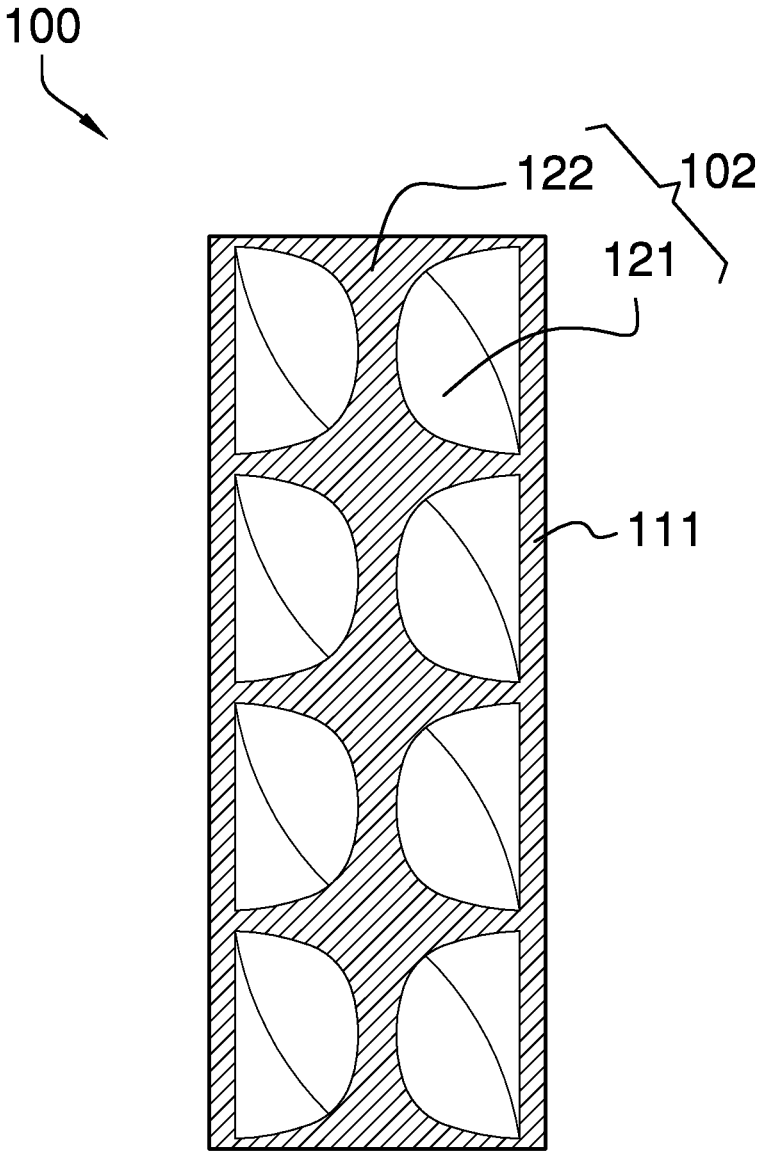
FIG. 5 is a cross-sectional view of an embodiment of the disclosure across 5-5 as shown in FIG. 4.
Figure 6:
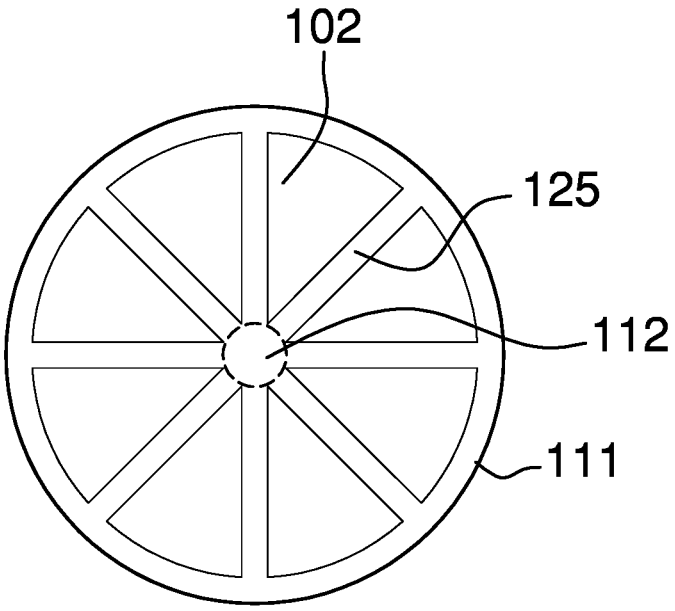
FIG. 6 is a top view of an alternate embodiment of the disclosure.

Detailed reference will now be made to one or more potential embodiments of the disclosure, which are illustrated in FIGS. 1 through 6.

The helicoid in a tube 100 (hereinafter invention) is an energy conversion device. The invention 100 converts energy in a manner selected from the group consisting of: a) converting the inertia of the mass of the flow of a fluid 131 through the invention 100 into rotational energy; b) converting a rotational energy into a change in the inertia of the mass of the fluid flow 131 through the invention 100; and, c) converting the inertia of the mass of the fluid flow 131 through the invention 100 into fluid turbulence, cavitation, and heat in the form of friction.

The invention 100 comprises a turbine stator 101 and a turbine rotor 102. The turbine rotor 102 installs in the turbine stator 101. The turbine rotor 102 rotates within the turbine stator 101 when the invention 100 converts the inertia of the mass of the fluid flow 131 through the invention 100 into rotational energy. The turbine rotor 102 rotates within the turbine stator 101 when the invention 100 converts rotational energy into a change in the inertia of the mass of the fluid flow 131 through the invention 100. The position of the turbine rotor 102 within the turbine rotor 102 remains stationary when the invention 100 converts the inertia of the mass of the fluid flow 131 through the invention 100 into fluid turbulence, cavitation, and heat in the form of friction.

The turbine rotor 102 is a mechanical structure. The turbine rotor 102 has a helicoid structure. The helicoid structure is defined elsewhere in this disclosure. The turbine rotor 102 is a mechanical structure that rotates within the turbine stator 101. The rotation of the turbine rotor 102 converts energy in a manner selected from the group consisting of: a) converting the inertia of the mass of the flow of a fluid 131 through the invention 100 into rotational energy; and, b) converts a rotational energy into a change in the inertia of the mass of the fluid flow 131 through the invention 100. The turbine rotor 102 can be locked into a fixed position.

When the turbine rotor 102 is locked into the fixed position, the turbine rotor 102 coverts the inertia of the mass of the fluid flow 131 through the invention 100 into fluid turbulence, cavitation, and heat in the form of friction. The fluid flow 131 passes through the turbine stator 101 such that the fluid flow 131 applies a force to the surfaces of the helicoid structure of the turbine rotor 102 that rotates the turbine rotor 102.

The turbine rotor 102 comprises a primary helicoid structure 121.

The primary helicoid structure 121 is a rigid structure. The primary helicoid structure 121 forms a helicoid surface. The helicoid structure and surface are defined in detail elsewhere in this disclosure.

The helicoid surface of the primary helicoid structure 121 is formed with a handedness selected from the group consisting of a right handedness and a left handedness. The terms right handed and left handed are defined elsewhere in this disclosure. The handedness of the primary helicoid structure 121 is related to the direction of rotation of the primary helicoid structure 121 within the turbine stator 101. The flow of the fluid 131 over the surfaces of the primary helicoid structure 121 generates the motive forces used to rotate the primary helicoid structure 121. The handedness of the primary helicoid structure 121 determines the direction of rotation of the primary helicoid structure 121 as the fluid flow 131 passes over the primary helicoid structure 121. The direction of rotation of a left handed primary helicoid structure 121 is opposite to the direction of rotation of a right handed primary helicoid structure 121.

The primary helicoid structure 121 forms the energy conversion structure of the invention 100. The flow of the fluid 131 over the surfaces of the primary helicoid structure 121 causes the rotation of the primary helicoid structure 121 such that the primary helicoid structure 121 converts the inertial energy of the mass of the fluid flow 131 into rotational energy. The rotation of the primary helicoid structure 121 by an external source of rotation energy generates motive forces that can be used to move static fluid contained within the invention 100 to generate a fluid flow 131. The flow of the fluid 131 over the surfaces of the primary helicoid structure 121 when the primary helicoid structure 121 is locked in a fixed position generates an audible turbulence and cavitation within the fluid flow 131. The primary helicoid structure 121 further comprises a primary axis of rotation 123. The axis of rotation is defined elsewhere in this disclosure.

In a second potential embodiment of the disclosure, the turbine rotor 102 further comprises a secondary helicoid structure 122.

The secondary helicoid structure 122 is a rigid structure. The secondary helicoid structure 122 forms a helicoid surface. The helicoid structure and surface are defined in detail elsewhere in this disclosure. The secondary helicoid structure 122 further comprises a secondary axis of rotation 124. The axis of rotation is defined elsewhere in this disclosure.

The helicoid surface of the secondary helicoid structure 122 is formed with a handedness selected from the group consisting of a right handedness and a left handedness. The terms right handed and left handed are defined elsewhere in this disclosure. The handedness of the secondary helicoid structure 122 is related to the direction of rotation of the secondary helicoid structure 122 within the turbine stator 101. The flow of the fluid 131 over the surfaces of the secondary helicoid structure 122 generates the motive forces used to rotate the secondary helicoid structure 122. The handedness of the secondary helicoid structure 122 determines the direction of rotation of the secondary helicoid structure 122 as the fluid flow 131 passes over the secondary helicoid structure 122. The direction of rotation of a left handed secondary helicoid structure 122 is opposite to the direction of rotation of a right handed secondary helicoid structure 122.

The secondary helicoid structure 122 is incorporated into the structure of the primary helicoid structure 121 such that the secondary helicoid structure 122 rotates in synchronization with the rotation of the primary helicoid structure 121. The secondary axis of rotation 124 is incorporated into the structure of the primary helicoid structure 121 such that the secondary axis of rotation 124 of the secondary helicoid structure 122 aligns with the primary axis of rotation 123 of the primary helicoid structure 121.

The secondary helicoid structure 122 is formed with a fixed mathematical phase relative to the primary helicoid structure 121. The mathematical phase of the secondary helicoid structure 122 is offset by 180 degrees relative to the primary helicoid structure 121. When the primary helicoid structure 121 and the secondary helicoid structure 122 have the same handedness, the additional surface area of the rotor structure 102 reduces the potential for variations in the energy conversion rate of the invention 100. When the primary helicoid structure 121 and the secondary helicoid structure 122 have the opposite handedness, the source of the fluid flow 131 can be configured such that the turbine rotor 102 will rotate in the same direction independently of the direction of the fluid flow 131 through the cylindrical shell 111.

In a third potential embodiment of the disclosure, the turbine rotor 102 further comprises the primary helicoid structure 121 and a plurality of supplemental helicoid structures 125. Each supplemental helicoid structure contained in the plurality of supplemental helicoid structures 125 has an identical structure to the secondary helicoid structure 122. The benefits of using a plurality of supplemental helicoid structures 125 include the further reduction of the variations in the energy conversion rate of the invention 100. The mathematical phase of each of the plurality of supplemental helicoid structures 125 is offset by a number of degrees relative to the primary helicoid structure 121. The number of degrees equals 360/(N+1) where N is the number of supplemental helicoid structures contained in the plurality of supplemental helicoid structures 125.

The turbine stator 101 contains the turbine rotor 102. The turbine stator 101 remains stationary as the turbine rotor 102 rotates within the turbine stator 101. The turbine stator 101 anchors the invention 100 to a fixed position relative to a larger structure. By fixed position relative to a larger structure is meant that turbine stator 101 is moving with the same velocity as the larger structure. The turbine stator 101 contains the fluid flow 131 moving through the invention 100. The turbine stator 101 channels the fluid flow 131 over the surface of the turbine rotor 102. The turbine stator 101 is a rigid structure. The turbine stator 101 has a prism shape. The turbine stator 101 has a tubular structure. The turbine rotor 102 is a rigid structure. The turbine stator 101 comprises a cylindrical shell 111 and a plurality of bearings 112.

The cylindrical shell 111 forms the exterior surfaces of the invention 100. The cylindrical shell 111 physically contains the turbine rotor 102. The cylindrical shell 111 is a rigid structure. The cylindrical shell 111 has a prism shape. The cylindrical shell 111 has a tubular structure. The cylindrical shell 111 has a cylindrical structure. The center axis of the cylindrical shell 111 aligns with the primary axis of rotation 123 of the primary helicoid structure 121 of the turbine rotor 102.

Each of the plurality of bearings 112 is a rolling element bearing based structure. The plurality of bearings 112 attaches the turbine rotor 102 to the cylindrical shell 111 such that the axis of rotation of the plurality of bearings 112 aligns with the axis of rotation of the turbine rotor 102. The plurality of bearings 112 attaches the turbine rotor 102 to the cylindrical shell 111 such that the axis of rotation of the plurality of bearings 112 aligns with the center axis of the cylindrical shell 111. A first bearing selected from the plurality of bearings 112 attaches to the turbine rotor 102 at a first congruent end of the prism structure of the cylindrical shell 111. A second bearing selected from the plurality of bearings 112 attaches to the turbine rotor 102 at a second congruent end of the prism structure of the cylindrical shell 111. The plurality of bearings 112 secures the turbine rotor 102 within the cylindrical shell 111 such that the turbine rotor 102 rotates freely within the cylindrical shell 111. At least one rolling element bearing selected from the plurality of bearings 112 is a locking bearing. The plurality of bearings 112 are used to lock the turbine rotor 102 into a fixed position.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bearing: As used in this disclosure, a bearing is a mechanical device that: 1) guides and limits the motion of a moving component relative to a fixed component; and, 2) reduces the friction between the moving component and the fixed component. A locking bearing is a bearing that can be locked such that the rotation of movements secured into a fixed position until the locking bearing is subsequently unlocked. The use of bearings is well known and documented in the mechanical arts.

Cant: As used in this disclosure, a cant is an angular deviation from one or more reference lines (or planes) such as a vertical line (or plane) or a horizontal line (or plane).

Cavitation: As used in this disclosure, cavitation refers to a turbulence in a fluid flow wherein the energy of the turbulence causes a phase change within the fluid that commonly appear as bubbles.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Clockwise: As used in this disclosure, clockwise refers to a direction of rotation as it appears to a viewer. The clockwise direction is defined as the rotational direction that is opposite to the counterclockwise direction.

Counterclockwise: As used in this disclosure, counterclockwise refers to a direction of rotation as it appears to a viewer. The counterclockwise direction is defined using a right hand rule. Specifically, when the viewer: 1) puts their right hand between the rotating object and themselves; and, 2) from this position points the thumb of their right hand directly at themselves; then, 3) when the viewer rotates their wrist, the fingers of the right hand will rotate in the counterclockwise direction.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Form Factor: As used in this disclosure, the term form factor refers to the size and shape of an object.

Friction: As used in this disclosure, friction refers to a force that occurs between two objects that are in relative motion while in contact with each other. The force resists the relative motion of the two objects. More technically, friction refers to an exchange of energy between two objects that are in contact with each other that converts the energy of a directed relative motion between the two objects into randomly directed motions of the molecules that form both objects.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Helicoid: As used in this disclosure, a helicoid is a three dimensional planar structure that corresponds to a helix. Specifically, the helicoid is a generalization of the helix structure that is defined by the parametric equation set: $x(t)=p \cos(at)$, $y(t)=p \sin(at)$, and $z=t$ where a is a constant. The helicoid forms a Euclidean (i.e. planar or uncurved) surface. The surface formed by the helicoid can be thought of as a plurality of individual and geometrically similar helixes that are juxtaposed together in the manner of a lateral disk structure. The helicoid has a handedness that is similar in structure and identification to the handedness of a helix.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute. The helix has a right handed and left handed orientation. When viewed along the center axis of the helix, if the helix structure moves away from the observer along the clockwise direction, the helix is considered a right handed helix. If the helix structure moves towards the observer along the clockwise direction, the helix is considered a left handed helix. The handedness of the helix does not depend on the end of the helix being viewed. The helix is mathematically defined by the parametric equation set: $x(t)=\cos(t)$, $y(t)=\sin(t)$, and $z=t$.

Inner Dimension: As used in this disclosure, the term inner dimension describes the span from a first inside or interior surface of a container to a second inside or interior surface of a container. The term is used in much the same way that a plumber would refer to the inner diameter of a pipe.

Lateral Prism Structure: As used in this disclosure, a lateral prism structure refers to the juxtaposition of a first lateral face of a first prism structure to a second lateral face of a second prism structure such that: a) the center axes of the first prism and the second prism are parallel; and, b) the congruent ends of the first prism are parallel to the congruent ends of the second prism. The span of the length of the center axes of the first prism and the second prism need not be equal. The form factor of the congruent ends of the first prism and the second prism need not be geometrically similar.

Liquid: As used in this disclosure, a liquid refers to a state (phase) of matter that is fluid and that maintains, for a given pressure, a fixed volume that is independent of the volume of the container.

Lock: As used in this disclosure, a lock is a fastening device that fixes the position of a first object relative to a second object such that the first object and the second object are subsequently releasable.

Mass: As used in this disclosure, refers to a quantity of matter within a structure. Mass is measured and quantified by the reaction of the structure to a force. Mass can also be roughly quantified as a function of atomic composition and the number of atoms contained within the structure. The term weight refers to the quantification of a mass that is exposed to the force of gravity.

Mathematical Phase: As used in this disclosure, the term phase refers to a constant offset formed between two otherwise identical periodic functions. If a first periodic function has the form $f(x)$ and a second periodic function has the form $f(x+c)$, where c is a constant, the term c is said to be the phase difference between $f(x)$ and $f(x+c)$.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Perimeter: As used in this disclosure, a perimeter is one or more curved or straight lines that bounds an enclosed area on a plane or surface. The perimeter of a circle is commonly referred to as a circumference.

Periodic: As used in this disclosure, the periodic refers to a function that has the property: $f(x)=f(x+nk)$ where n is an integer selected the group consisting of: a) n is a positive integer; and, b) n is a negative integer. The term k is said to be the "period" of the periodic function $f(x)$. A physical structure that can be described by a periodic function is called a periodic structure.

Phase: As used in this disclosure, phase refers to the state of the form of matter. The common states of matter are solid, liquid, gas, and plasma.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rigid Structure: As used in this disclosure, a rigid structure is a solid structure formed from an inelastic material that resists changes in shape. A rigid structure will permanently deform as it fails under a force. See bimodal flexible structure.

Rolling Element Bearing: As used in this disclosure, a rolling element bearing comprises is a type of bearing comprising an inner race, and outer race, and a plurality of ball bearings. The plurality of ball bearings are sphere shaped. The inner race is a circular ring. The outer race is a circular ring with an inner diameter that is greater than the outer diameter of the inner race. The plurality of ball bearings are placed between the inner race and the outer race such that: 1) the inner race and the outer race are coaxially positioned; and, 2) the inner race rotates relative to the outer race. Typically, the inner race attaches to a first object and the outer race attaches to a second object such that the first object rotates relative to the second object. Typically, a rolling element bearing is disk shaped. A rolling element bearing is said to be "locking" when the relative position of the inner race in be locked into a fixed position relative to the outer race. Rolling element bearings, including locking versions, are: 1) commercially available; and, 2) well-known and documented in the mechanical arts.

Rotor: As used in this disclosure, a rotor is: 1) the bladed rotating part of a turbine; or, 2) the rotating part of an electric motor, electric generator, or an alternator.

Stator: As used in this disclosure, a stator is: 1) the stationary structure of a turbine; or, 2) the stationary structure of an electric motor, electric generator, or an alternator.

Turbine: In this disclosure, a turbine is a machine that converts the kinetic energy of a moving fluid or gas to rotational energy. In common usage, a turbine generally accomplishes this by forcing the moving fluid or gas through a series of blades arrayed around the circumference of a wheel or a cylinder. Alternative, a turbine can run in a reverse mode wherein externally provided rotational energy will be converted into kinetic energy that is expressed as the movement or compression of a fluid or gas.

Turbulence: As used in this disclosure, turbulence describes the motion or flow of a fluid wherein the velocities and pressures within the fluid flow will vary randomly or in an incalculably complex fashion.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An energy conversion device comprising
a turbine stator and a turbine rotor;
wherein the turbine rotor installs in the turbine stator;
wherein the energy conversion device converts energy in a manner selected from the group consisting of: a) converting an inertia of a mass of a flow of a fluid through the energy conversion device into rotational energy; b) converting a rotational energy into a change in an inertia of a mass of a fluid flow through the energy conversion device; and, c) converting an inertia of a mass of a fluid flow through the energy conversion device into fluid turbulence, cavitation, and heat in the form of friction;
wherein the turbine rotor has a helicoid structure;
wherein the turbine rotor is a mechanical structure that rotates within the turbine stator;
wherein the turbine rotor can be locked into a fixed position;
wherein the fluid flow passes through the turbine stator such that the fluid flow applies a force to the surfaces of the helicoid structure of the turbine rotor that rotates the turbine rotor;
wherein the turbine rotor rotates within the turbine stator when the energy conversion device converts the inertia of the mass of the fluid flow through the energy conversion device into rotational energy;
wherein the turbine rotor rotates within the turbine stator when the energy conversion device converts rotational energy into a change in the inertia of the mass of the fluid flow through the energy conversion device;
wherein the position of the turbine rotor within the turbine rotor remains stationary when the energy conversion device converts the inertia of the mass of the fluid flow through the energy conversion device into fluid turbulence, cavitation, and heat in the form of friction.

2. The energy conversion device according to claim 1
wherein the turbine rotor comprises a primary helicoid structure;
wherein the primary helicoid structure is a rigid structure;
wherein the primary helicoid structure forms a helicoid surface;
wherein the flow of the fluid over the surfaces of the primary helicoid structure generates the motive forces used to rotate the primary helicoid structure;
wherein the primary helicoid structure further comprises a primary axis of rotation.

3. The energy conversion device according to claim 2
wherein the helicoid surface of the primary helicoid structure is formed with a handedness selected from the group consisting of a right handedness and a left handedness;
wherein the handedness of the primary helicoid structure is related to the direction of rotation of the primary helicoid structure within the turbine stator;
wherein the handedness of the primary helicoid structure determines the direction of rotation of the primary helicoid structure as the fluid flow passes over the primary helicoid structure.

4. The energy conversion device according to claim 3
wherein the turbine stator contains the turbine rotor;
wherein the turbine stator remains stationary as the turbine rotor rotates within the turbine stator;
wherein the turbine stator anchors the energy conversion device to a fixed position relative to a larger structure;
wherein by fixed position relative to a larger structure is meant that turbine stator is moving with the same velocity as the larger structure;

wherein the turbine stator contains the fluid flow moving through the energy conversion device;

wherein the turbine stator channels the fluid flow over the surface of the turbine rotor.

5. The energy conversion device according to claim 4 wherein the turbine stator is a rigid structure;

wherein the turbine stator has a tubular structure;

wherein the turbine rotor is a rigid structure;

wherein the turbine stator comprises a cylindrical shell and a plurality of bearings;

wherein the plurality of bearings secure the turbine rotor to the turbine stator.

6. The energy conversion device according to claim 5 wherein the cylindrical shell forms the exterior surfaces of the energy conversion device;

wherein the cylindrical shell physically contains the turbine rotor;

wherein the cylindrical shell is a rigid structure;

wherein the cylindrical shell has a tubular structure;

wherein the cylindrical shell has a cylindrical structure;

wherein a center axis of the cylindrical shell aligns with the primary axis of rotation of the primary helicoid structure of the turbine rotor.

7. The energy conversion device according to claim 6 wherein each of the plurality of bearings is a rolling element bearing based structure;

wherein the plurality of bearings attaches the turbine rotor to the cylindrical shell such that an axis of rotation of the plurality of bearings aligns with the axis of rotation of the turbine rotor;

wherein the plurality of bearings attaches the turbine rotor to the cylindrical shell such that the axis of rotation of the plurality of bearings aligns with the center axis of the cylindrical shell;

wherein a first bearing selected from the plurality of bearings attaches to the turbine rotor at a first congruent end of the cylindrical shell;

wherein a second bearing selected from the plurality of bearings attaches to the turbine rotor at a second congruent end of the cylindrical shell;

wherein the plurality of bearings secures the turbine rotor within the cylindrical shell such that the turbine rotor rotates freely within the cylindrical shell;

wherein at least one rolling element bearing selected from the plurality of bearings is a locking bearing;

wherein the plurality of bearings are used to lock the turbine rotor into a fixed position.

8. The energy conversion device according to claim 3 wherein, the turbine rotor further comprises a secondary helicoid structure;

wherein the secondary helicoid structure is a rigid structure;

wherein the secondary helicoid structure forms a helicoid surface;

wherein the secondary helicoid structure further comprises a secondary axis of rotation.

9. The energy conversion device according to claim 8 wherein the helicoid surface of the secondary helicoid structure is formed with a handedness selected from the group consisting of a right handedness and a left handedness;

wherein the handedness of the secondary helicoid structure determines the direction of rotation of the secondary helicoid structure as the fluid flow passes over the secondary helicoid structure.

10. The energy conversion device according to claim 9 wherein the secondary helicoid structure is incorporated into the structure of the primary helicoid structure such that the secondary helicoid structure rotates in synchronization with the rotation of the primary helicoid structure;

wherein the secondary axis of rotation is incorporated into the structure of the primary helicoid structure such that the secondary axis of rotation of the secondary helicoid structure aligns with the primary axis of rotation of the primary helicoid structure.

11. The energy conversion device according to claim 10 wherein the secondary helicoid structure is formed with a fixed mathematical phase relative to the primary helicoid structure;

wherein the mathematical phase of the secondary helicoid structure is offset by 180 degrees relative to the primary helicoid structure;

wherein when the primary helicoid structure and the secondary helicoid structure have the same handedness, the additional surface area of the rotor structure reduces the variation in the energy conversion rate of the energy conversion device.

12. The energy conversion device according to claim 11 wherein when the primary helicoid structure and the secondary helicoid structure have the opposite handedness, the source of the fluid flow can be configured such that the turbine rotor will rotate in the same direction independently of the direction of the fluid flow through the cylindrical shell.

13. The energy conversion device according to claim 12 wherein the turbine stator is a rigid structure;

wherein the turbine stator has a tubular structure;

wherein the turbine rotor is a rigid structure;

wherein the turbine stator comprises a cylindrical shell and a plurality of bearings;

wherein the plurality of bearings secure the turbine rotor to the turbine stator.

14. The energy conversion device according to claim 13 wherein the cylindrical shell forms the exterior surfaces of the energy conversion device;

wherein the cylindrical shell physically contains the turbine rotor;

wherein the cylindrical shell is a rigid structure;

wherein the cylindrical shell has a tubular structure;

wherein the cylindrical shell has a cylindrical structure;

wherein the center axis of the cylindrical shell aligns with the primary axis of rotation of the primary helicoid structure of the turbine rotor.

15. The energy conversion device according to claim 14 wherein each of the plurality of bearings is a rolling element bearing based structure;

wherein the plurality of bearings attaches the turbine rotor to the cylindrical shell such that the axis of rotation of the plurality of bearings aligns with the axis of rotation of the turbine rotor;

wherein the plurality of bearings attaches the turbine rotor to the cylindrical shell such that the axis of rotation of the plurality of bearings aligns with the center axis of the cylindrical shell;

wherein a first bearing selected from the plurality of bearings attaches to the turbine rotor at a first congruent end of the cylindrical shell;

wherein a second bearing selected from the plurality of bearings attaches to the turbine rotor at a second congruent end of the cylindrical shell;

wherein the plurality of bearings secures the turbine rotor within the cylindrical shell such that the turbine rotor rotates freely within the cylindrical shell;

wherein at least one rolling element bearing selected from the plurality of bearings is a locking bearing;

wherein the plurality of bearings are used to lock the turbine rotor into a fixed position.

16. The energy conversion device according to claim 12 wherein the turbine rotor further comprises a plurality of supplemental helicoid structures;

wherein each supplemental helicoid structure contained in the plurality of supplemental helicoid structures has an identical structure to the secondary helicoid structure;

wherein the mathematical phase of each of the plurality of supplemental helicoid structures is offset by a number of degrees relative to the primary helicoid structure;

wherein the number of degrees equals 360/(n+1) where n is the number of supplemental helicoid structures contained in the plurality of supplemental helicoid structures.

17. The energy conversion device according to claim 16 wherein the turbine stator is a rigid structure;

wherein the turbine stator has a tubular structure;

wherein the turbine rotor is a rigid structure;

wherein the turbine stator comprises a cylindrical shell and a plurality of bearings;

wherein the plurality of bearings secure the turbine rotor to the turbine stator.

18. The energy conversion device according to claim 17 wherein the cylindrical shell forms the exterior surfaces of the energy conversion device;

wherein the cylindrical shell physically contains the turbine rotor;

wherein the cylindrical shell is a rigid structure;

wherein the cylindrical shell has a tubular structure;

wherein the cylindrical shell has a cylindrical structure;

wherein the center axis of the cylindrical shell aligns with the primary axis of rotation of the primary helicoid structure of the turbine rotor.

19. The energy conversion device according to claim 18 wherein each of the plurality of bearings is a rolling element bearing based structure;

wherein the plurality of bearings attaches the turbine rotor to the cylindrical shell such that the axis of rotation of the plurality of bearings aligns with the axis of rotation of the turbine rotor;

wherein the plurality of bearings attaches the turbine rotor to the cylindrical shell such that the axis of rotation of the plurality of bearings aligns with the center axis of the cylindrical shell;

wherein a first bearing selected from the plurality of bearings attaches to the turbine rotor at a first congruent end of the cylindrical shell;

wherein a second bearing selected from the plurality of bearings attaches to the turbine rotor at a second congruent end of the cylindrical shell;

wherein the plurality of bearings secures the turbine rotor within the cylindrical shell such that the turbine rotor rotates freely within the cylindrical shell;

wherein at least one rolling element bearing selected from the plurality of bearings is a locking bearing;

wherein the plurality of bearings are used to lock the turbine rotor into a fixed position.

* * * * *